US011143199B2

(12) United States Patent
Iwakiri

(10) Patent No.: US 11,143,199 B2
(45) Date of Patent: Oct. 12, 2021

(54) COMPRESSOR IMPELLER, COMPRESSOR, AND TURBOCHARGER

(71) Applicant: MITSUBISHI HEAVY INDUSTRIES ENGINE & TURBOCHARGER, LTD., Sagamihara (JP)

(72) Inventor: Kenichiro Iwakiri, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 16/618,703

(22) PCT Filed: Nov. 15, 2017

(86) PCT No.: PCT/JP2017/041128
§ 371 (c)(1),
(2) Date: Dec. 2, 2019

(87) PCT Pub. No.: WO2019/097611
PCT Pub. Date: May 23, 2019

(65) Prior Publication Data

US 2020/0116158 A1 Apr. 16, 2020

(51) Int. Cl.
*F01D 5/02* (2006.01)
*F01D 5/04* (2006.01)
(Continued)

(52) U.S. Cl.
CPC ..... *F04D 29/284* (2013.01); *F01D 5/025* (2013.01); *F01D 5/048* (2013.01); *F01D 5/30* (2013.01);
(Continued)

(58) Field of Classification Search
CPC . F01D 5/025; F01D 5/048; F01D 5/30; F01D 5/34; F04D 29/266; F04D 29/284; F04D 29/30; F05D 2220/40
See application file for complete search history.

(56) References Cited

U.S. PATENT DOCUMENTS 3,961,867 A 6/1976 Woollenweber
7,568,883 B2 8/2009 Arnold et al.
(Continued)

FOREIGN PATENT DOCUMENTS

CN 103362557 B 4/2016
DE 2 141 262 A1 2/1973
(Continued)

OTHER PUBLICATIONS

Taburri et al., A model-based methodology to predict the compressor behaviour for the simulation of turbocharged engines, Jul. 29, 2011, pp. 560-574 (Year: 2011).*
(Continued)

*Primary Examiner* — Audrey B. Walter
(74) *Attorney, Agent, or Firm* — Birch, Stewart, Kolasch & Birch, LLP

(57) ABSTRACT

A compressor impeller includes an impeller body which includes a boss portion and a plurality of compressor blades disposed on an outer peripheral surface of the boss portion, and a connection portion which is disposed on a side of a back surface of the impeller body and is configured to be connectable to one end of a rotational shaft. A ratio D1/D2 satisfies 0.18 or less, where D1 is a diameter of the boss portion on leading edges of the compressor blades, and D2 is a maximum outer diameter of the compressor blades.

8 Claims, 7 Drawing Sheets

(51) Int. Cl.

| | |
|---|---|
| ***F01D 5/30*** | (2006.01) |
| ***F01D 5/34*** | (2006.01) |
| ***F04D 29/26*** | (2006.01) |
| ***F04D 29/28*** | (2006.01) |
| ***F04D 29/30*** | (2006.01) |

(52) U.S. Cl.
CPC ..... *F01D 5/34* (2013.01); *F04D 29/266* (2013.01); *F04D 29/30* (2013.01); *F05D 2220/40* (2013.01)

(56) References Cited

U.S. PATENT DOCUMENTS

| | | | | |
|---|---|---|---|---|
| 2010/0202875 | A1 | 8/2010 | Schlienger et al. | |
| 2014/0314590 | A1* | 10/2014 | Ising ..... | F02B 37/004 417/405 |
| 2015/0275921 | A1 | 10/2015 | Pinkney et al. | |

FOREIGN PATENT DOCUMENTS

| | | | |
|---|---|---|---|
| JP | 50-30110 | A | 3/1975 |
| JP | 57-167295 | U | 10/1982 |
| JP | 63-79495 | U | 5/1988 |
| JP | 8-326689 | A | 12/1996 |
| JP | 2006-226199 | A | 8/2006 |
| JP | 2009-209867 | A | 9/2009 |
| JP | 2011-122539 | A | 6/2011 |
| JP | 2013-185543 | A | 9/2013 |
| JP | 2013-224614 | A | 10/2013 |

OTHER PUBLICATIONS

Turbo Rebuild Limited Woldwide Turbocharger Supplies, Billet Alloy Turbo Compressor Wheels, accessed 2020 (Year: 2020).*

Office Action dated Jul. 13, 2020 issued in counterpart Chinese Application No. 201780092276.9 with Machine Translation.

International Preliminary Report on Patentability and the English translation of the Written Opinion of the International Searching Authority for International Application No. PCT/JP2017/041128, dated May 28, 2020.

International Search Report for International Application No. PCT/JP2017/041128, dated Feb. 20, 2018.

Extended European Search Reoprt dated Mar. 18, 2021 issued to the corresponding European Application No. 17931949.6.

* cited by examiner

COMPRESSOR IMPELLER, COMPRESSOR, AND TURBOCHARGER

TECHNICAL FIELD

The present disclosure relates to a compressor impeller, a compressor, and a turbocharger.

BACKGROUND

Conventionally, a compressor and a rotating machine including the compressor have been known. The compressor flows fluid such as air or a gas in a radial direction of a rotating compressor impeller and compresses the fluid by utilizing a centrifugal force generated at this time.

For example, Patent Document 1 and Patent Document 2 each disclose a turbocharger which rotates a turbine impeller by utilizing an exhaust gas and rotates a compressor impeller disposed coaxially with the turbine impeller, thereby increasing a suction pressure of an internal combustion engine.

CITATION LIST

Patent Literature

Patent Document 1: JP2009-209867A
Patent Document 2: U.S. Pat. No. 7,568,883B

SUMMARY

Technical Problem

Recently, however, demand for downsizing and larger capacity of a compressor is increasing, and thus it is desirable to ensure the capacity of the compressor while suppressing upsizing of the compressor.

Thus, in view of the above, an object of at least some embodiments of the present invention is to provide a compressor impeller, a compressor, and a turbocharger capable of increasing the capacity of the compressor while suppressing upsizing thereof.

Solution to Problem (1) A compressor impeller according to some embodiments of the present invention includes an impeller body which includes a boss portion and a plurality of compressor blades disposed on an outer peripheral surface of the boss portion, and a connection portion which is disposed on a side of a back surface of the impeller body and is configured to be connectable to one end of a rotational shaft. A ratio D1/D2 satisfies 0.18 or less, where D1 is a diameter of the boss portion on leading edges of the compressor blades, and D2 is a maximum outer diameter of the compressor blades.

With the above configuration (1), since the connection portion disposed on the side of the back surface of the impeller body is configured to be connectable to the one end of the rotational shaft, it is possible to configure the compressor impeller to be rotatable without providing a through hole for letting through the rotational shaft in the boss portion. Thus, it is possible to decrease the diameter of the boss portion on the leading edges of the compressor blades as compared with the structure of the impeller where the through hole is provided in the boss portion (through-bore structure). As a result, it is possible to increase the flow passage area of fluid guided to the compressor impeller, and thus it is possible to increase the capacity of the compressor while promoting downsizing thereof.

(2) In some embodiments, in the above configuration (1), the connection portion includes a fastening portion configured to fasten and fix the one end of the rotational shaft.

With the above configuration (2), since the connection portion disposed on the side of the back surface of the impeller body includes the fastening portion, it is possible to fix the one end of the rotational shaft to the connection portion by the fastening portion. Thus, it is possible to couple the rotational shaft and the compressor impeller to each other without providing an additional fastening member on the side of the leading edges of the compressor blades. Therefore, it is possible to promote the decrease in the diameter of the boss portion on the side of the leading edges of the compressor blades and to increase the flow passage area, as also described in the above configuration (1).

(3) In some embodiments, in the above configuration (1) or (2), the boss portion has a solid structure at least between the connection portion and the leading edges.

With the above configuration (3), as compared with the through-bore structure in which a centrifugal stress is likely to be generated with concentration in the through hole, it is possible to disperse the centrifugal stress by adopting the solid structure. Accordingly, it is possible to effectively reduce a maximum centrifugal stress, and thus to increase the flow rate and improve durability of the compressor impeller at the same time.

(4) In some embodiments, in any one of the above configurations (1) to (3), the compressor blades include fillet portions in blade root parts thereof, the fillet portions each being disposed on a connection part with the boss portion, and a ratio $\Sigma t/L$ has a maximum value in at least a partial region, where t is blade thicknesses of the compressor blades including the fillet portions in the blade root parts, $\Sigma t$ is a total of the blade thicknesses t of the compressor blades in a circumferential direction, and L is a perimeter of the boss portion, and the maximum value satisfies 0.5 or more.

In order to increase the flow rate, it is desirable to decrease the diameter of the boss portion and to increase the flow passage area. In this regard, with the above configuration (4), $\Sigma t/L$ has the maximum value in at least the partial region, and the maximum value satisfies 0.5 or more. Thus, it is possible to effectively reduce the perimeter L of the boss portion and to increase the flow passage area in a region where $\Sigma t/L$ reaches the maximum value. Therefore, it is possible to increase the capacity of the compressor.

(5) In some embodiments, in the above configuration (4), a pair of compressor blades adjacent to each other in the circumferential direction are configured such that the fillet portions contact each other at a position where the ratio $\Sigma t/L$ reaches the maximum value, and a tangent direction of each of the fillet portions at a contact point between the fillet portions matches a tangent direction of a virtual arc defined by a diameter of the boss portion at the position.

Since the fillet portions for reducing a stress concentration are typically provided in the blade root parts, the ends of the fillet portions of the adjacent blades become close to each other as the diameter of the boss portion is reduced and eventually contact each other. If the diameter of the boss portion is further reduced from a state in which the ends of the fillet portions contact each other, the fillet portions contact each other via a discontinuous point, and the stress may be likely to concentrate in the vicinity of the discontinuous point. Therefore, while it is desirable to decrease the diameter of the boss portion with the object of increasing the flow rate, it is desirable to increase the diameter of the boss portion to some extent so the ends of the fillet portions of the adjacent blades do not contact each other via the discontinuous point from the perspective of durability of the blade root parts.

In this regard, with the above configuration (5), since the boss diameter is set which allows the fillet portions to be smoothly connected to each other at the position where the ratio $\Sigma t/L$, reaches the maximum value, it is possible to improve durability of the compressor impeller by relaxing the stress concentration in blade roots while ensuring the large flow passage area.

(6) In some embodiments, in the above configuration (4) or (5), the ratio $\Sigma t/L$ of the total $\Sigma t$ of the blade thicknesses t to the perimeter L of the boss portion has the maximum value within a range where a meridional length ratio is not less than 0 and not greater than 0.5.

In the typical compressor impeller, the blade thicknesses t tend to relatively increase between the leading edges and a position where the meridional length ratio is 0.5, and the diameter of the boss portion tends to increase from the leading edges toward the trailing edges. Thus, with the above configuration (6), it is possible to reduce the diameter of the boss portion such that $\Sigma t/L$ has the maximum value between the leading edges and the position where the meridional length ratio is 0.5. At the position, the blade thicknesses t relatively increase, and the diameter of the boss portion relatively decreases. Thus, it is possible to effectively increase the flow passage area and to increase the capacity of the compressor.

(7) In some embodiments, in any one of the above configurations (1) to (6), the boss portion includes an inclined surface extending radially inward from an axial position of blade root parts on the leading edges of the compressor blades toward an upstream side and having an inclination angle θ of a tangent direction with respect to an axial direction in an axial cross-section, the inclination angle θ satisfying $0<\theta[\text{deg}]\leq 30$, and a ratio D3/D1 satisfies 0.5 or less, where D3 is a diameter of the boss portion at an upstream end of the inclined surface, and D1 is the diameter of the boss portion on the leading edges of the compressor blades.

With the object of improving efficiency of the compressor by smoothly guiding a flow on an inlet side of the impeller, it is desirable to suppress a disturbance in the flow on the upstream side of the leading edges of the compressor blades.

In this regard, with the above configuration (7), it is possible to form the shape of the boss portion from an upstream end of the inclined surface to the leading edges of the compressor blades to be continuous and smooth. It is also possible to form the shape of the boss portion to be suitable for obtaining a rectifying effect by adopting a configuration in which the inclination angle θ of the inclined surface satisfies $0<\theta[\text{deg}]\leq 30$, and the diameter ratio D3/D1 of the boss portion satisfies 0.5 or less. As a result, it is possible to suppress the disturbance in the flow and to smoothly guide the flow on the inlet side of the impeller, making it possible to improve efficiency of the compressor.

(8) In some embodiments, in the above configuration (7), the boss portion includes a tip part of a semi-elliptical shape having a major axis in the axial direction.

With the above configuration (8), it is possible to reduce a collision loss when the axial flow collides with the tip part of the boss portion and to improve efficiency of the compressor.

(9) A compressor according to some embodiments of the present invention includes the compressor impeller according to any one of the above configurations (1) to (8) and a compressor housing disposed so as to cover the compressor impeller.

With the above configuration (9), since the connection portion disposed on the side of the back surface of the impeller body is configured to be connectable to the one end of the rotational shaft as described in the above configuration (1), it is possible to configure the compressor impeller to be rotatable without providing the through hole for letting through the rotational shaft in the boss portion. Thus, it is possible to decrease the diameter of the boss portion on the leading edges of the compressor blades as compared with the structure of the impeller where the through hole is provided in the boss portion (through-bore structure). As a result, it is possible to increase the flow passage area of fluid guided to the compressor impeller, and thus it is possible to increase the capacity of the compressor while promoting downsizing thereof.

(10) A turbocharger according to some embodiments of the present invention includes the compressor according to the above configuration (9) and a turbine including a turbine impeller and configured to drive the compressor by an exhaust gas.

With the above configuration (10), since it is possible to increase the capacity of the compressor by increasing the flow passage area of air introduced into the compressor, it is possible to improve efficiency of the turbocharger.

Advantageous Effects

According to at least one embodiment of the present invention, it is possible to provide a compressor impeller, a compressor, and a turbocharger capable of achieving a beneficial effect of increasing allow rate while promoting downsizing of the compressor.

BRIEF DESCRIPTION OF DRAWINGS

FIG. 4A shows the flow in a through-bore structure, and FIG. 4B shows the flow in a boreless structure.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

Figure 1:
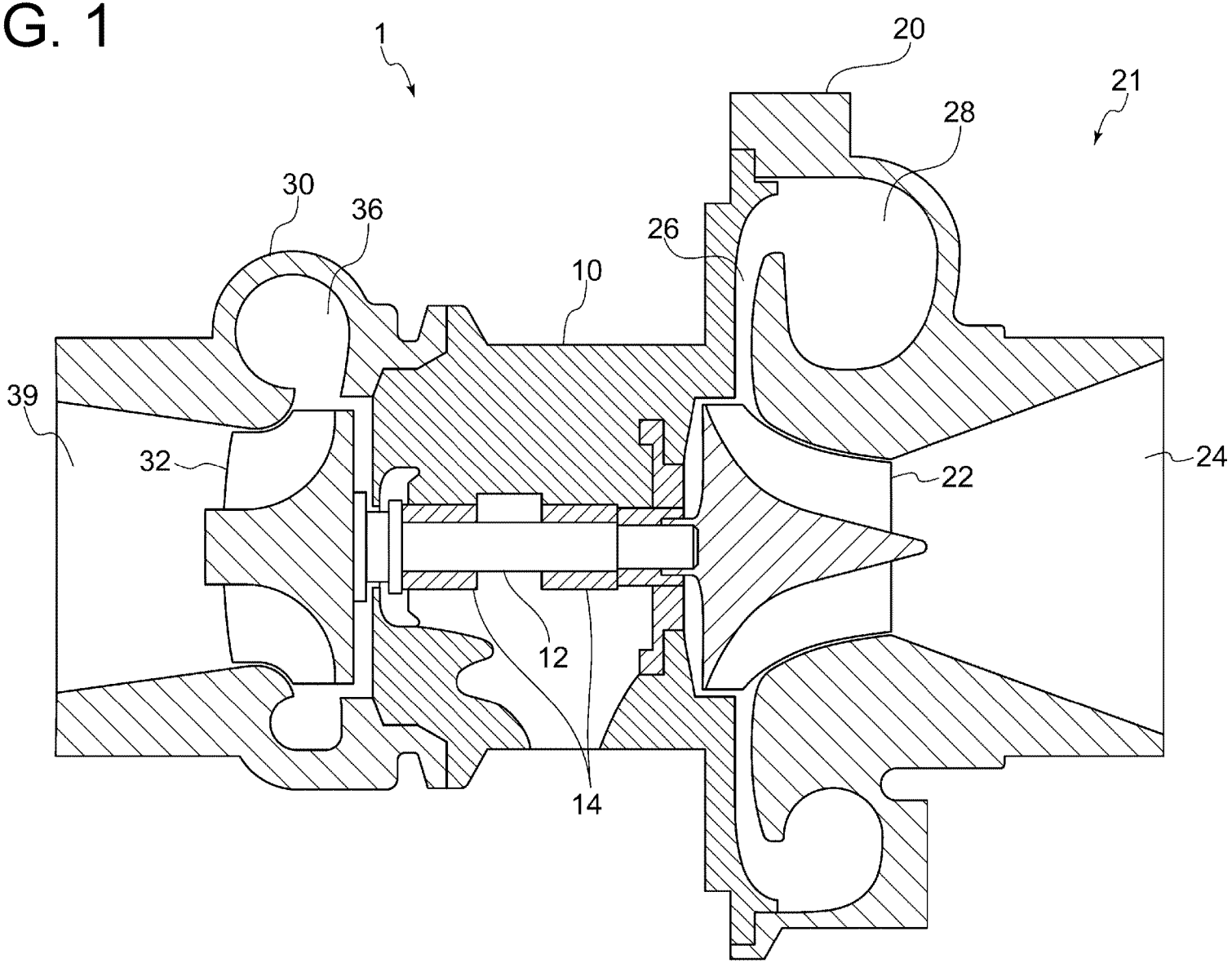
FIG. 1 is a cross-sectional view showing the schematic configuration of a turbocharger to which a compressor impeller is applied according to some embodiments.

First, the overall configuration of a turbocharger to which a compressor impeller is applied according to some embodiments will be described with reference to FIG. 1. FIG. 1 is a cross-sectional view showing the schematic configuration of a turbocharger 1 to which a compressor 21 is applied according to an embodiment. In each embodiment to be described later, the turbocharger 1 is exemplified as the application of a compressor impeller 22 according to the present invention. However, the present invention is not limited to this. The compressor impeller 22 can be applied to, for example, an industrial centrifugal compressor, a blower, or the like other than the turbocharger.

As shown in FIG. 1, the turbocharger 1 according to some embodiments of the present invention includes a compressor housing 20 and a turbine housing 30 arranged across a bearing housing 10. A rotational shaft 12 includes a turbine impeller 32 housed in the turbine housing 30 at one end and includes a compressor impeller 22 housed in the compressor housing 20 at the other end. The rotational shaft 12, the turbine impeller 32, and the compressor impeller 22 are coupled or linked to each other, thereby forming a single-piece as a whole. The rotational shaft 12 is rotatably supported by bearings 14 disposed in the bearing housing 10.

In the compressor housing 20, an air inlet portion 24 for introducing air into the compressor housing 20 is formed. Air compressed by the rotation of the compressor impeller 22 passes through a diffuser flow passage 26 and a compressor scroll flow passage 28, and is discharged to the outside of the compressor housing 20 via an air outlet portion (not shown).

In the turbine housing 30, a gas inlet portion (not shown) for introducing an exhaust gas from an engine (not shown) into the turbine housing 30 is formed. The gas inlet portion can be connected to an exhaust manifold (not shown) of the engine. In addition, in an outer circumferential part of the turbine impeller 32 in the turbine housing 30, a scroll flow passage 36 is disposed so as to cover the turbine impeller 32. The scroll flow passage 36 communicates with the gas inlet portion and is formed so as to internally introduce the exhaust gas. The exhaust gas is guided from the scroll flow passage 36 to the turbine impeller 32, and is discharged to the outside of the turbine housing 30 via a gas outlet portion 39 after passing through the turbine impeller 32.

As described above, the turbocharger 1 can transmit a rotational force to the compressor impeller 22 via the rotational shaft 12 by rotary driving the turbine impeller 32 with the exhaust gas of the engine, centrifugally compress air entering the compressor housing 20, and supply the compressed air to the engine.

Next, an example of the shape of a boss portion of the compressor impeller 22 according to some embodiments will be described.

Figure 2:
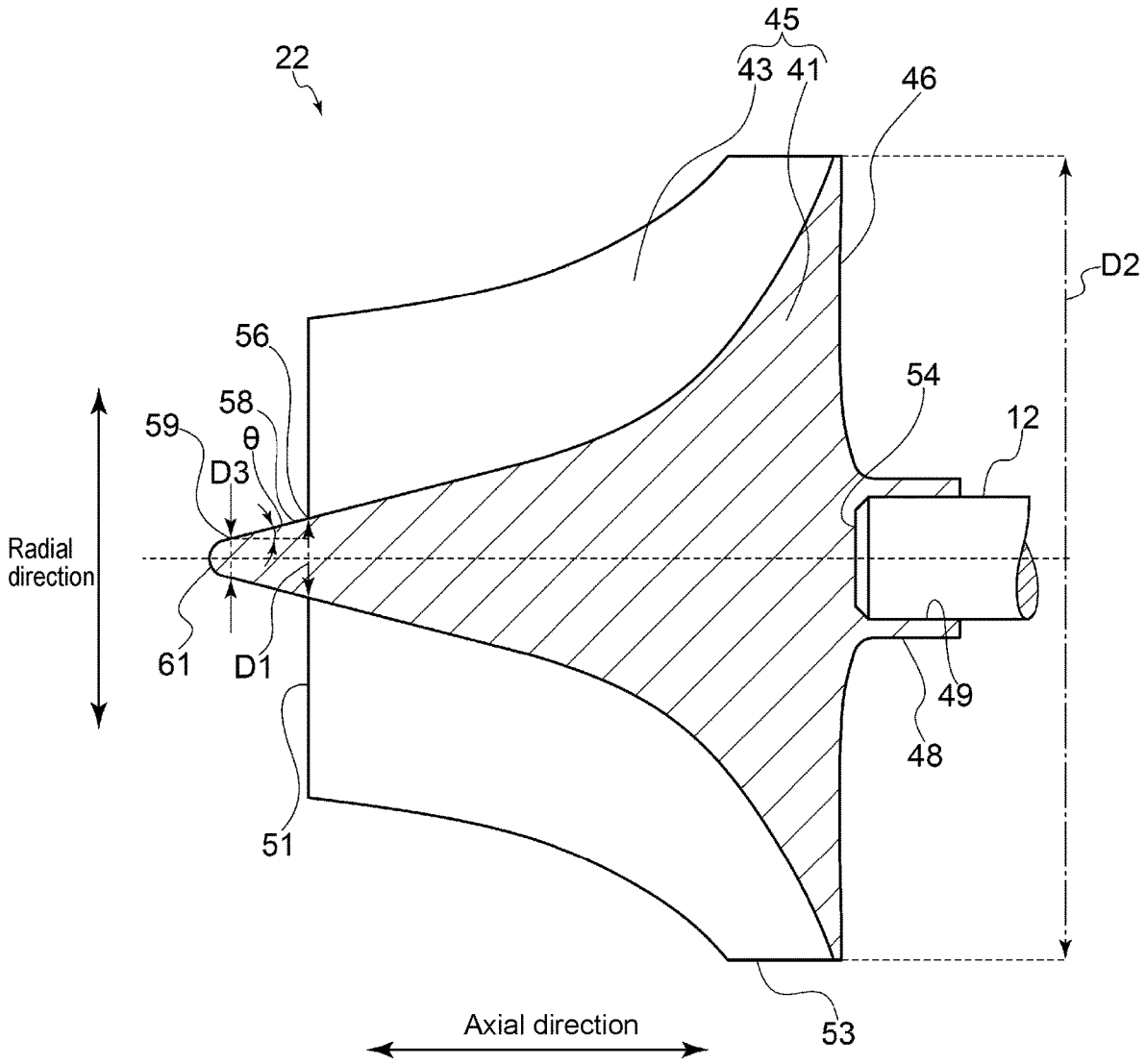
FIG. 2 is an enlarged view of the vicinity of a compressor in the turbocharger.

FIG. 2 is an enlarged view of the vicinity of the compressor impeller 22 in the turbocharger 1. As shown in FIG. 2, the compressor impeller 22 according to some embodiments includes an impeller body 45 and a connection portion 48. The impeller body 45 includes a boss portion 41 and a plurality of compressor blades 43 disposed on an outer peripheral surface of the boss portion 41. The connection portion 48 is disposed on the side of a back surface 46 of the impeller body 45 and is configured to be connectable to one end of the rotational shaft 12. Then, a ratio D1/D2 satisfies 0.18 or less, where D1 is a diameter of the boss portion 41 on leading edges 51 of the compressor blades 43, and D2 is a maximum outer diameter of the compressor blades 43.

As a general structure of the compressor impeller 22, a through-bore structure in which the boss portion 41 has a through hole is known. In the through-bore structure, the rotational shaft 12 is typically fastened by a nut disposed on an inlet side of the impeller in order to fix the impeller body 45 and the rotational shaft 12 passing through the through hole. However, the through-bore structure in which the nut is disposed on the inlet side limits a reduction in the boss diameter D1 on the leading edges 51 even though it is desirable to reduce the boss diameter D1 on the leading edges 51 in order to ensure the capacity of the compressor 21 upon downsizing thereof.

Figure 3:
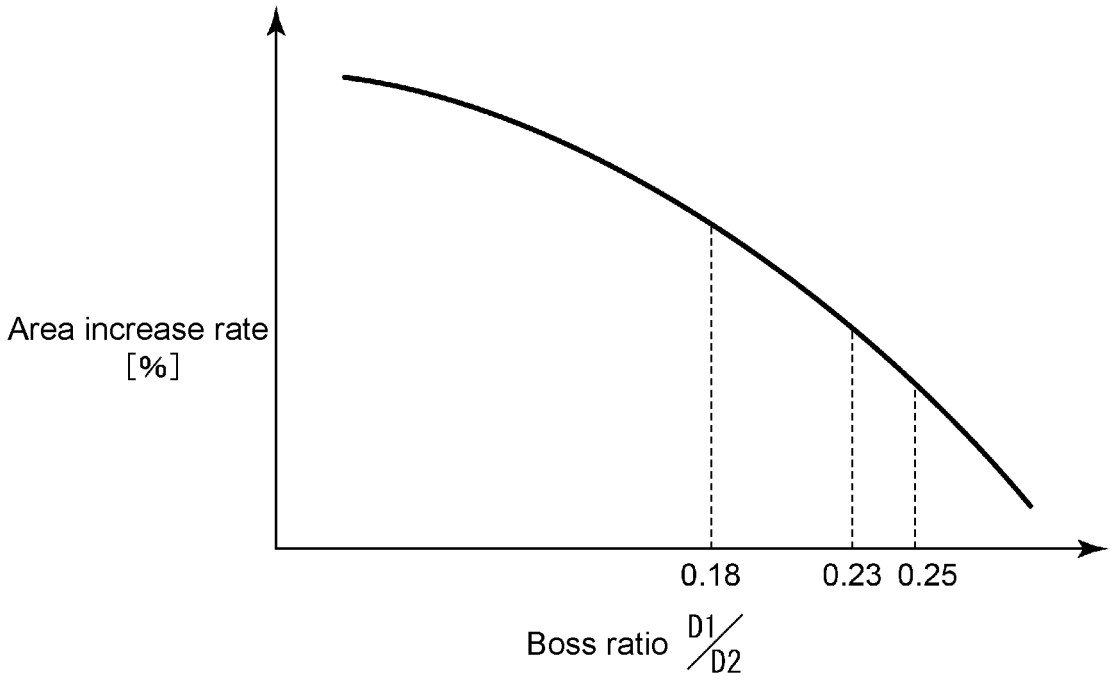
FIG. 3 is a graph of a relationship between a boss ratio D1/D2 and a flow passage area increase rate.

FIG. 3 is a graph of a relationship between the boss ratio D1/D2 and a flow passage area increase rate. In the case of a typical through-bore structure, the boss ratio D1/D2 has a value near 0.23 to 0.25. Moreover, with the object of reliably fastening the compressor impeller and the rotational shaft, it is necessary to adopt a nut of a size commensurate with the physical size (maximum outer diameter D2) of the compressor blades. Therefore, despite the attempt to reduce the boss diameter on the inlet side as much as possible in the through-bore structure, it is impossible to reduce the boss diameter to be smaller than a minimum nut diameter which is needed to obtain a sufficient fastening force. Thus, in the through-bore structure, it is difficult to decrease the boss ratio D1/D2 to fall below a limit value (about 0.18) which is defined by a restriction that it is impossible to reduce the boss diameter to be smaller than the minimum nut diameter.

Thus, in the present embodiment, a structure is adopted in which the rotational shaft 12 is connected to the connection portion 48 on the side of the back surface 46 of the impeller body 45, making it possible to configure the compressor impeller 22 to be rotatable without providing the through hole in the boss portion 41 (boreless structure). Unlike the through-bore structure, in the boreless structure, the boss portion 41 positioned on the leading edges 51 is not involved in fastening the compressor impeller 22 and the rotational shaft 12. Therefore, in the boreless structure, the boss diameter D1 on the leading edges 51 is set more flexibly, and it is possible to decrease the boss diameter D1 on the leading edges 51 of the compressor blades 43 as compared with the through-bore structure. Thus, it is possible to achieve the boss ratio D1/D2 not greater than 0.18 by adopting the boreless structure as in the present embodiment. As a result, as shown in the graph of FIG. 3, it is possible to increase the flow passage area of the fluid guided to the compressor impeller 22, and thus it is possible to increase the capacity of the compressor 21 while promoting downsizing thereof.

In some embodiments, as shown likewise in FIG. 2, the connection portion 48 is disposed so as to protrude from the back surface of the boss portion 41 in the axial direction. The connection portion 48 includes a fastening portion 49 configured to fasten and fix the one end of the rotational shaft 12. In the embodiment exemplified in FIG. 2, a structure is adopted in which female threading is applied to the inside of the fastening portion 49, and the rotational shaft 12 outside of which undergoes male threading corresponding to the female threading is directly fastened to the fastening portion 49. However, the present embodiment is not limited to this. The male-female relationship between the fastening portion 49 and the rotational shaft 12 may be reversed (that is, while male threading is applied to the outside of the fastening portion 49, female threading may be applied to the inside of a recess disposed on the tip surface of the rotational shaft 12), or the rotational shaft 12 may be coupled to the connection portion 48 via another member.

According to the present embodiment, since the connection portion 48 disposed on the side of the back surface 46 of the impeller body 45 includes the fastening portion 49, it is possible to fix the one end of the rotational shaft 12 to the connection portion 48 by the fastening portion 49. Thus, it is possible to couple the rotational shaft 12 and the compressor impeller 22 to each other without providing a fastening member such as a nut on the side of the leading edges 51 of the compressor blades 43. Therefore, it is possible to promote the decrease in the diameter of the boss portion 41 on the side of the leading edges 51 of the compressor blades 43 and to increase the flow passage area, as also described in the above embodiment.

Further, in some embodiments, the boss portion 41 has a solid structure at least between the connection portion 48 and the leading edges 51. The solid structure refers to a state in which the interior is buried without having any through hole, groove, or the like.

According to the present embodiment, as compared with the through-bore structure in which a centrifugal stress is likely to be generated with concentration in the through hole, it is possible to disperse the centrifugal stress by adopting the solid structure. Accordingly, it is possible to effectively reduce a maximum centrifugal stress, and thus to increase the flow rate and improve durability of the compressor impeller 22 at the same time.

In the exemplary embodiment of FIG. 2, the fastening portion 49 is disposed behind an axial position where the impeller body 45 has the maximum outer diameter D2. At this time, a leading end 54 of the rotational shaft 12 is positioned behind the axial position where the impeller body 45 has the maximum outer diameter D2.

In the through-bore structure, the centrifugal stress generated in the through hole becomes maximum in the vicinity of the axial position where the impeller body 45 has the maximum outer diameter. Thus, according to the present embodiment, it is possible to improve durability of the compressor impeller 22 and to achieve the higher pressure ratio of the compressor 21 by adopting the solid structure at least in the range of the axial position where the maximum centrifugal stress can be generated to effectively disperse the centrifugal stress.

In the above description, "front" and "behind" are defined as follows. That is, in the axial direction, the side of the air inlet portion 24 as viewed from the compressor impeller 22 is referred to as "front", and the side opposite to the air inlet portion 24 as viewed from the compressor impeller 22 will be referred to as "behind".

Moreover, as shown in FIG. 2, in the compressor impeller 22 according to some embodiments, the boss portion 41 includes an inclined surface 58 extending radially inward from an axial position of blade root parts 56 on the leading edges 51 of the compressor blades 43 toward the upstream side and having an inclination angle θ of a tangent direction with respect to the axial direction in an axial cross-section. The inclination angle θ satisfies $0<\theta[\text{deg}]\leq 30$. Then, a ratio D3/D1 satisfies 0.5 or less, where D3 is a diameter of the boss portion at an upstream end 59 of the inclined surface 58, and D1 is the boss diameter on the leading edges 51 of the compressor blades 43.

The inclined surface 58 continuously exists in the axial direction from the axial position of the blade root parts 56 on the leading edges 51 toward the upstream side of the outer peripheral surface of the boss portion 41, and refers to an entire region satisfying $0<\theta[\text{deg}]\leq 30$. For example, if $0<\theta[\text{deg}]<30$ is satisfied at the axial position of the blade root parts 56 on the leading edges 51, the angle θ gradually increases toward the upstream side until the angle reaches 30 degrees at a particular axial position, and the angle θ exceeds 30 degrees on a further upstream side (the tip side of the boss portion 41), the axial position where the angle θ reaches 30 degrees is the upstream end 59 of the inclined surface 58. On the other hand, if the relation of $0<\theta[\text{deg}]\leq 30$ is satisfied over an entire range from the axial position of the blade root parts 56 on the leading edges 51 to an axial position at the tip of the boss portion 41, the tip of the boss portion 41 is the upstream end 59 of the inclined surface 58.

In the exemplary embodiment of FIG. 2, the entire inclined surface 58 is oblique with respect to the axial direction, allowing the inclination angle θ to satisfy $0<\theta[\text{deg}]\leq 30$. Moreover, the boss portion 41 includes a semi-circular tip part 61 at the end of the upstream end 59 of the inclined surface 58. The entire outer shape of the boss portion 41 is continuously and smoothly formed from the tip part 61 to trailing edges 53 of the compressor blades 43.

Figure 4A:
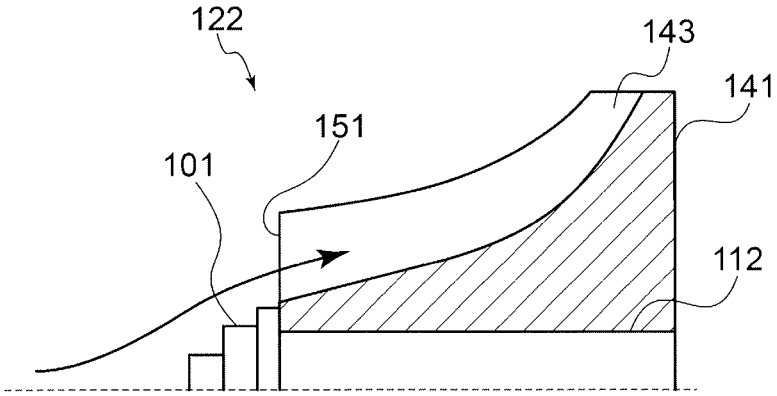
FIGS. 4A and 4B are cross-sectional views for comparing the flow of fluid between the upstream sides of compressor impellers.
Figure 4B:
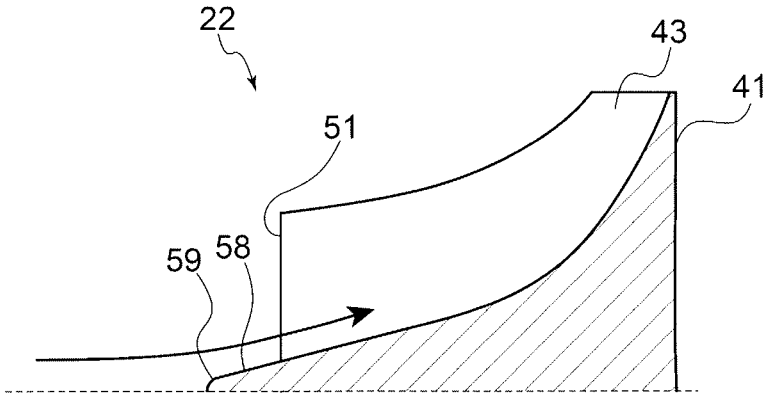

The advantageous effect of the present embodiment will be described as contrasted with the through-bore structure. FIGS. 4A and 4B are cross-sectional views for comparing the flow of fluid between the upstream sides of the compressor impeller 22 and a compressor impeller 122. FIG. 4A shows the flow in the through-bore structure, and FIG. 4B shows the flow in the boreless structure.

As shown in FIG. 4A, the through-bore structure has a configuration in which a nut 101 is provided on the upstream side of the compressor impeller 122 to fasten a rotational shaft 112. Consequently, an outer shape on the upstream side of a leading edge 151 of a compressor blade 143 includes steps generated by the shape of the nut 101, and is thus discontinuous. Due to the discontinuous shape, the flow flowing in the compressor impeller 122 may be disturbed, leading to a decrease in efficiency of the compressor 21. Therefore, with the object of improving efficiency of the compressor 21 by smoothly guiding the flow on the inlet side of the compressor impeller 122, it is desirable to suppress the disturbance in the flow on the upstream side of the leading edge 151 of the compressor blade 143.

In this regard, according to the present embodiment, it is possible to form the shape of the boss portion 41 from the upstream end 59 of the inclined surface 58 to the leading edge 51 of the compressor blade 43 to be continuous and smooth. It is also possible to form the shape of the boss portion 41 to be suitable for obtaining a rectifying effect by adopting a configuration in which the inclination angle θ of the inclined surface 58 satisfies $0<\theta[\text{deg}]<30$, and the diameter ratio D3/D1 of the boss portion 41 satisfies 0.5 or less. As a result, as shown in FIG. 4B, it is possible to smoothly guide the flow on the inlet side of the compressor impeller 22 along the outer shape of the boss portion 41, making it possible to suppress the disturbance in the flow and to improve efficiency of the compressor 21.

Figure 5:
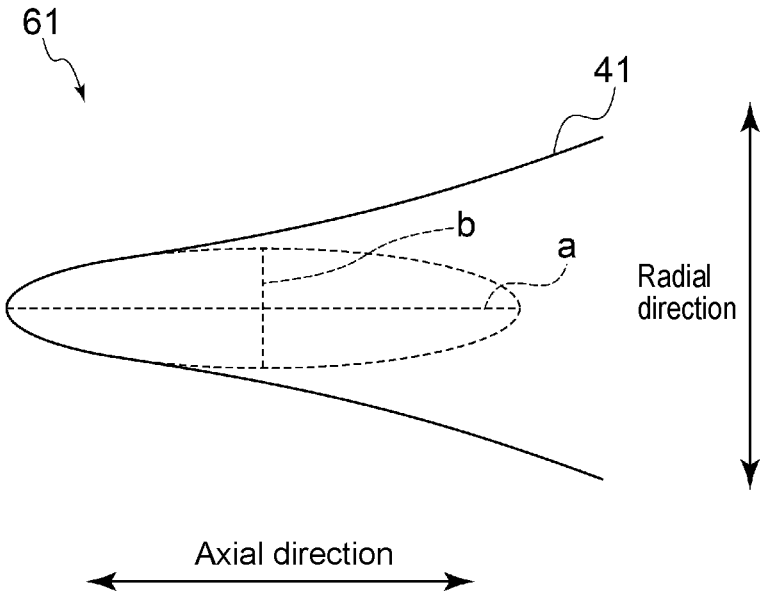
FIG. 5 is an enlarged view of the vicinity of a tip part of a boss portion according to some embodiments.

FIG. 5 is an enlarged view of the vicinity of the tip part 61 of the boss portion 41 according to some embodiments. In some embodiments, as shown in FIG. 5, the boss portion 41 includes the tip part 61 of a semi-elliptical shape having a major axis "a" in the axial direction. The tip part 61 need not have an accurate semi-ellipse which is obtained by halving an entire ellipse by a minor axis b in the direction of the major axis "a". As illustrated in FIG. 5, it is only necessary that the tip part 61 includes at least a part of the entire ellipse in the direction of the major axis "a" and is configured such that the tip of the tip part 61 is shaped to be pointed toward the upstream side.

According to the present embodiment, it is possible to prevent the tip part 61 from broadening in the radial direction by setting the major axis "a" of the ellipse in the axial direction of the compressor impeller 22. Thus, it is possible to reduce a collision loss when the axial flow collides with the tip part 61 of the boss portion 41 and to improve efficiency of the compressor 21.

Figure 6A:
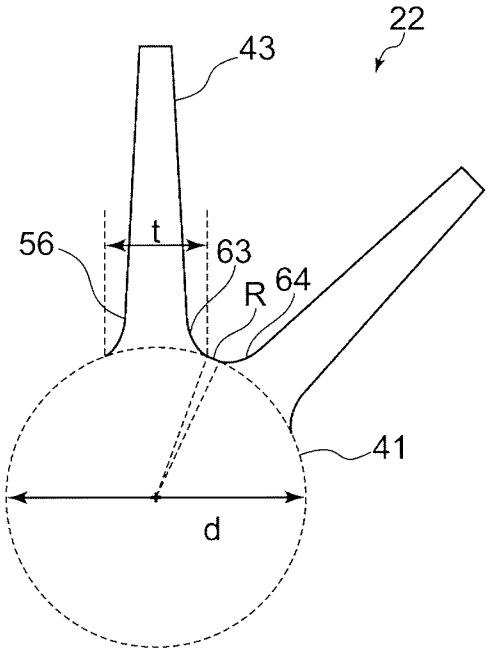
FIGS. 6A to 6C are views for comparing the cross-sectional shape of the compressor impeller as seen in the axial direction when a boss diameter varies.
Figure 6B:
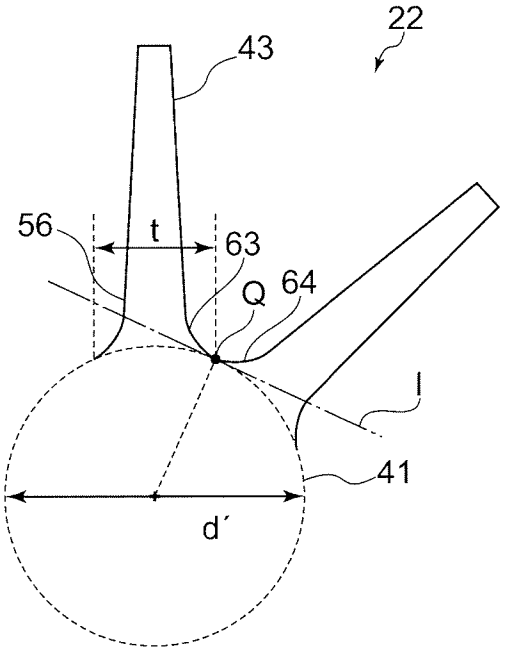
Figure 6C:
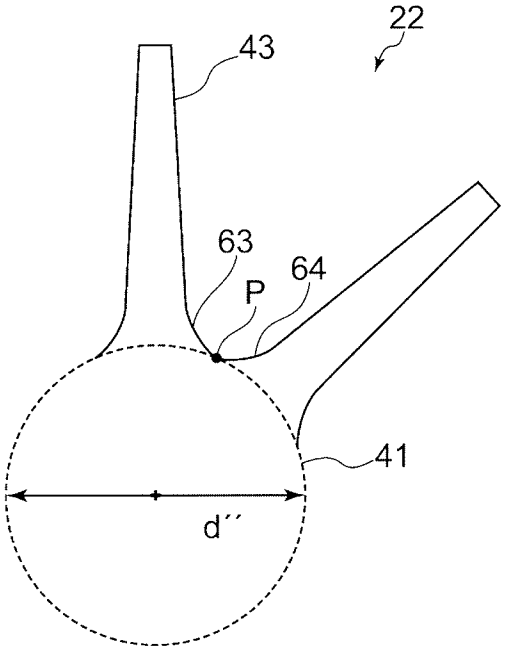
Figure 7:
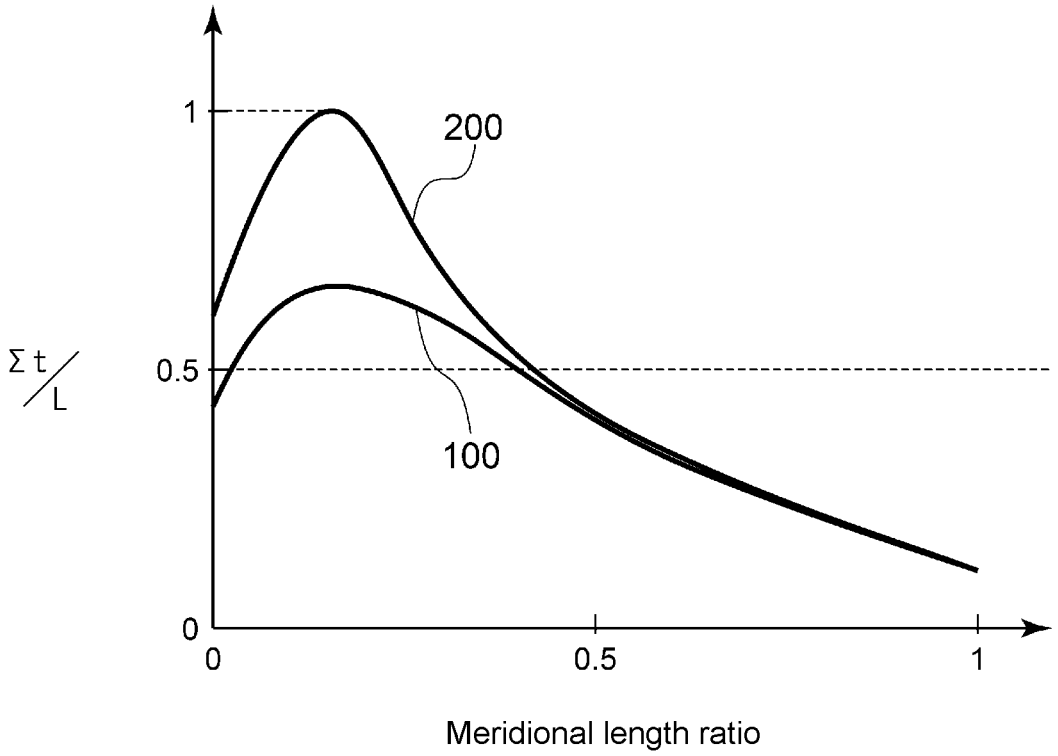
FIG. 7 is a graph of a relationship between a meridional length ratio and a ratio Et/L of a total of blade thicknesses to a perimeter of the boss portion.

Regarding the diameter of the boss portion 41 in an axial range from the leading edges 51 to the trailing edges 53 of the compressor blades 43, some embodiments will be described below with reference to FIGS. 6A to 6C and 7. FIGS. 6A to 6C are views for comparing the cross-sectional shape of the compressor impeller 22 as seen in the axial direction when the boss diameter varies. FIG. 7 is a graph of a relationship between a meridional length ratio and a ratio Σt/L of a total of blade thicknesses to a perimeter L of the boss portion 41.

As shown in each of FIGS. 6A to 6C, the compressor blade 43 includes a fillet portion 63 disposed on a connection part with the boss portion 41 in the blade root part 56. The fillet portion 63 is typically provided in order to ensure a strength in the blade root part 56 where a stress is likely to concentrate. In a state shown in FIG. 6A, the boss diameter is denoted by reference character d, the fillet portion 63 and a fillet portion 64 adjacent to each other do not contact each other, and between the adjacent fillet portions (63, 64), an arc R defined by the boss diameter d is interposed. FIG. 6B shows a state in which the boss diameter is denoted by reference character d', and the boss diameter d' is smaller than the boss diameter d. At this time, the ends of the adjacent fillet portions (63, 64) just contact each other via a continuous point Q. Thus, in the compressor impeller 22 including the fillet portion 63, the ends of the fillet portions (63, 64) of the adjacent compressor blades 43 become close to each other as the diameter of the boss portion 41 is reduced and eventually contact each other when the boss portion 41 reaches a certain diameter.

If the boss diameter is further reduced from the state in which the ends of the fillet portions (63, 64) contact each other as shown in FIG. 6B and is denoted by reference character d", the fillet portions (63, 64) contact each other via a discontinuous point P as shown in FIG. 6C. In this case, the stress is likely to concentrate in the vicinity of the discontinuous point P, which may lead to a decrease in durability of the blade root parts 56 as compared with cases in FIGS. 6A and 6B. Therefore, while it is desirable to decrease the diameter of the boss portion 41 with the object of increasing the flow rate, it is desirable to increase the diameter of the boss portion 41 to some extent so the ends of the fillet portions (63, 64) of the adjacent compressor blades 43 do not contact each other via the discontinuous point P from the perspective of durability of the blade root parts 56.

Thus, in some embodiments, as indicated by a curve 100 of FIG. 7, the ratio Σt/L of a total Σt of blade thicknesses t of the compressor blades 43 in the circumferential direction to the perimeter L of the boss portion 41 has a maximum value in at least a partial region, and the maximum value satisfies 0.5 or more.

The abscissa of the graph in FIG. 7 indicates the ratio of the length on the meridional plane from the leading edges 51 to each position to the entire length along the meridional plane of the compressor blades 43. The meridional length ratio is 0 at positions on the leading edges 51 and is 1 at positions on the trailing edges 53.

The blade thickness t denotes the blade thickness in the blade root part 56 of the compressor blade 43 including the fillet portion 63. As shown in FIG. 6A or FIG. 6B, the blade thickness t is a value defined in the state in which the ends of the adjacent fillet portions (63, 64) are separated from each other or contact each other via the continuous point Q. Therefore, neither the blade thickness t nor the ratio Σt/L cannot be assumed in the state in which the ends of the adjacent fillet portions (63, 64) contact each other via the discontinuous point P as a result of the blade root parts 56 getting too close to each other as shown in FIG. 6C.

According to the present embodiment, the ratio Σt/I has the maximum value in at least the partial region, and the maximum value satisfies 0.5 or more. Thus, it is possible to effectively reduce the perimeter L of the boss portion 41 and to increase the flow passage area at a position where Σt/L reaches the maximum value. Therefore, it is possible to increase the capacity of the compressor 21.

Moreover, in some embodiments, as shown in FIG. 6B, a pair of compressor blades 43 adjacent to each other in the circumferential direction contact each other at the position where the ratio Σt/L reaches the maximum value. Then, the tangent direction of each of the fillet portions (63, 64) at the continuous point Q serving as a contact point between the fillet portions (63, 64) matches the direction of a tangent 1 of a virtual arc (an arc which is indicated by a dashed line indicating the boss portion 41) defined by the diameter d' of the boss portion 41 at the position.

At this time, adding the blade thicknesses t of the compressor blades 43 in the circumferential direction, Σt becomes the same value as the perimeter L of the boss portion 41, and thus Σt/L becomes 1. In FIG. 7, a curve 200 shows an example in which Σt/L has the maximum value of 1. At an axial position where Σt/L has a value smaller than 1, as shown in FIG. 6A, the state is obtained in which the arc R defined by the boss diameter d is interposed between the adjacent fillet portions (63 64).

According to the present embodiment, since the boss diameter is set which allows the fillet portions (63, 64) to be smoothly connected to each other at the axial position where the ratio Σt/L reaches the maximum value, it is possible to improve durability od the compressor impeller 22 by relaxing the stress concentration in the blade root parts 56 while ensuring the large flow passage area by decreasing the perimeter L relative to the total Σt of the blade thicknesses t.

In some embodiments, the ratio Σt/L of the total Σt of the blade thicknesses t to the perimeter L of the boss portion has the maximum value in a positional range where the meridional length ratio is not less than 0 and not greater than 0.5.

In the typical compressor impeller 22, the blade thicknesses t tend to relatively increase between the leading edges 51 and a position where the meridional length ratio is 0.5, and the diameter of the boss portion 41 tends to increase from the leading edges 51 toward the trailing edges 53. Thus, according to the present embodiment, it is possible to reduce the diameter of the boss portion 41 such that Σt/L has the maximum value between the leading edges 51 and the position where the meridional length ratio is 0.5. At the position, the blade thicknesses t relatively increase, and the diameter of the boss portion 41 relatively decreases. Thus, it is possible to effectively increase the flow passage area and to increase the capacity of the compressor 21.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

As used herein, the expressions "comprising", "containing" or "having" one constitutional element is not an exclusive expression that excludes the presence of other constitutional elements.

REFERENCE SIGNS LIST

1 Turbocharger
10 Bearing housing
12 Rotational shaft
14 Bearing
20 Compressor housing
21 Compressor
22 Compressor impeller
24 Air inlet portion
26 Diffuser flow passage
28 Scroll flow passage
30 Turbine housing
32 Turbine impeller
36 Scroll flow passage
41 Boss portion
43 Compressor blade
45 Impeller body
46 Back surface
48 Connection portion
49 Fastening portion
51 Leading edge
53 Trailing edge
54 Leading end
56 Blade root part
58 Inclined surface
59 Upstream end
61 Tip part
63, 64 Fillet portion
101 Nut
P Discontinuous point
Q Continuous point
R Arc
a Major axis
b Minor axis

The invention claimed is:

1. A compressor impeller comprising:

an impeller body which includes a boss portion and a plurality of compressor blades disposed on an outer peripheral surface of the boss portion; and a connection portion which is disposed on a side of a back surface of the impeller body and is configured to be connectable to one end of a rotational shaft, wherein a ratio D1/D2 satisfies 0.18 or less, where D1 is a diameter of the boss portion on leading edges of the compressor blades, and D2 is a maximum outer diameter of the compressor blades, wherein the compressor blades include fillet portions in blade root parts thereof, the fillet portions each being disposed on a connection part with the boss portion, wherein a ratio $\Sigma t/L$ has a maxi mu m value at a position at which a meridional length ratio is greater than 0 and not greater than 0.5, where t is blade thicknesses of the compressor blades including: the fillet portions in the blade root parts, $\Sigma t$ is a total of the blade thicknesses t of the compressor blades in a circumferential direction, L is a perimeter of the boss portion, and the maximum value satisfies 0.5 or more, and the meridional length ratio is a ratio of a length on a meridional plane from the leading edge of each of the compressor blades to an entire length of said each of the compressor blades along the meridional plane of said each of the compressor blades, wherein the ratio $\Sigma t/L$ increases from the leading edge of said each of the compressor blades toward the position so as to reach the maximum value at the position.

2. The compressor impeller according to claim 1, wherein the connection portion includes a fastening portion configured to fasten and fix the one end of the rotational shaft.

3. The compressor impeller according to claim 1, wherein the boss portion has a solid structure at least between the connection portion and the leading edges.

4. The compressor impeller according to claim 1, wherein a pair of compressor blades adjacent to each other in the circumferential direction are configured such that the fillet portions contact each other at the position where the ratio $\Sigma t/L$ reaches the maximum value, and wherein a tangent direction of each of the fillet portions at a contact point between the fillet portions matches a tangent direction of a virtual arc defined by a diameter of the boss portion at the position.

5. The compressor impeller according to claim 1, wherein the boss portion includes an inclined surface extending radially inward from an axial position of blade root parts on the leading edges of the compressor blades toward an upstream side and having an inclination angle $\theta$ of a tangent direction with respect to an axial direction in an axial cross-section, the inclination angle $\theta$ satisfying $0<\theta[\text{deg}]<30$, and wherein a ratio D3/D1 satisfies 0.5 or less, where D3 is a diameter of the boss portion at an upstream end of the inclined surface, and D1 is the diameter of the boss portion on the leading edges of the compressor blades.

6. The compressor impeller according to claim 1, wherein the boss portion includes a tip part of a semi-elliptical shape having a major axis in the axial direction.

7. A compressor comprising the compressor impeller according to claim 1; and a compressor housing disposed so as to cover the compressor impeller.

8. A turbocharger comprising:

the compressor according to claim 7; and a turbine including a turbine impeller and configured to drive the compressor by an exhaust gas.

* * * * *